US008533862B2

(12) United States Patent
Khandelwal

(10) Patent No.: US 8,533,862 B2
(45) Date of Patent: Sep. 17, 2013

(54) QUICKLY RELEASABLE VEST

(75) Inventor: Manish Khandelwal, Kanpur (IN)

(73) Assignee: MKU PVT Ltd., Kanpur (IN)

( * ) Notice: Subject to any disclaimer, the term of this patent is extended or adjusted under 35 U.S.C. 154(b) by 84 days.

(21) Appl. No.: 12/518,202

(22) PCT Filed: Sep. 17, 2008

(86) PCT No.: PCT/IN2008/000593
§ 371 (c)(1),
(2), (4) Date: Oct. 27, 2009

(87) PCT Pub. No.: WO2009/047790
PCT Pub. Date: Apr. 16, 2009

(65) Prior Publication Data

US 2010/0043112 A1 Feb. 25, 2010

(30) Foreign Application Priority Data

Oct. 8, 2007 (IN) ..... 2093/DEL/2007
Jan. 23, 2008 (IN) ..... 194/DEL/2008

(51) Int. Cl.
*F41H 1/02* (2006.01)

(52) U.S. Cl.
USPC ..... 2/2.5; 2/102

(58) Field of Classification Search
USPC ..... 2/2.5, 102, 243.1, 462–465, 467, 2/455; 24/614, 615, 587.12, 578.1, 573.09, 24/578.15, 579.09, 579.11, 581.11
See application file for complete search history.

(56) References Cited

U.S. PATENT DOCUMENTS

| | | | | | |
|---|---|---|---|---|---|
| 5,310,378 | A * | 5/1994 | Shannon | 446/268 |
| 5,822,792 | A * | 10/1998 | Reinhart, Jr. | 2/49.1 |
| 6,032,289 | A * | 3/2000 | Villapiano | 2/102 |
| 6,163,884 | A * | 12/2000 | Rosch et al. | 2/75 |
| 7,168,133 | B2 * | 1/2007 | Luo et al. | 16/303 |
| 7,895,719 | B2 * | 3/2011 | Woods | 24/625 |
| 2002/0092140 | A1 * | 7/2002 | Van Tassel | 24/614 |
| 2002/0120973 | A1 | 9/2002 | D'Annunzio | |
| 2002/0133922 | A1 * | 9/2002 | Uehara et al. | 24/615 |
| 2005/0005342 | A1 | 1/2005 | Johnson | |
| 2005/0015837 | A1 * | 1/2005 | Saito | 2/2.5 |

FOREIGN PATENT DOCUMENTS

| | | | |
|---|---|---|---|
| GB | 577 157 | A | 5/1946 |
| JP | 200617332 | A | 1/2006 |
| JP | 2006017332 | * | 1/2006 |

* cited by examiner

*Primary Examiner* — Khoa Huynh
*Assistant Examiner* — Andrew W Collins
(74) *Attorney, Agent, or Firm* — Don J. Pelto, Esquire; Sheppard, Mullin, Richter & Hampton LLP

(57) ABSTRACT

A quickly releasable vest capable of protecting a torso portion of a user is disclosed. The quickly releasable vest includes a first torso panel, a second torso panel, a plurality of plug members, a plurality of socket members and a quick release mechanism. The plurality of plug members is disposed on the first torso panel. The plurality of socket members is disposed on the second torso panel. Each of the plurality of socket members is configured to detachably couple to one of the plurality of plug members disposed on the first torso panel. The quick release mechanism is disposed on the first torso panel. The quick release mechanism includes a pull cord and a plurality of connecting tapes. The quick release mechanism is configured to separate the first torso panel from the second torso panel.

18 Claims, 17 Drawing Sheets

QUICKLY RELEASABLE VEST

FIELD OF THE INVENTION

The present invention relates generally to garments, and, more particularly, to self protection vests.

BACKGROUND OF THE INVENTION

Vests are configured to cover a torso portion of a user. The vests are disposed on the shoulder portion of the user by means of cables, buckles and the like. The vests are of different types such as exercise vests, cooling vests, protective vests and the like. The protective vests are used to protect the torso portion of the user against an impact. The protective vests may also be referred to as bulletproof vests. The bullet proof vests include bullet resistance armor.

The bulletproof vests for military operations worn by soldiers are heavier than the bulletproof vests worn by others like police or security guard because the soldiers need protection from powerful bullets from rifle or machine gun. The soldiers, according to mission, may also require various accessories such as pouches, magazines, water carrier, medical kit, small portable walkie-talkie sets and the like which can be positioned or fixed on the bullet proof vest as per the convenience of the soldier. The various accessories positioned on the bullet proof vest make the bullet proof vest heavy. During various emergency military operations such as, evacuation, running fast in forest or going through water, it will be necessary to quickly separate the vest from the body of the soldier for either better efficiency or to save his life.

Thus there is a need for a vest that is capable of being separated easily from a torso portion of a user.

SUMMARY OF THE INVENTION

In view of the foregoing disadvantages inherent in the prior art, the general purpose of the present invention is to provide a quickly releasable vest configured to include all the advantages of the prior art, and to overcome the drawbacks inherent therein.

Accordingly, an object of the present invention is to provide a quickly releasable vest, which is capable of being dressed in and separated easily by a user.

Yet another object of the present invention is to provide a quickly releasable vest, which is capable of being used by the persons such as soldiers, police, security guards and the like involved in military and other tactical operations.

Still another object of the present invention is to provide a quickly releasable vest, which is capable of protecting at least a torso portion of a user.

Accordingly, the present invention provides a quickly releasable vest capable of protecting a torso portion of a user. The quickly releasable vest includes a first torso panel, a second torso panel, a plurality of plug members, a plurality of socket members and a quick release mechanism. The plurality of plug members is disposed on the first torso panel. The plurality of socket members is disposed on the second torso panel. Each of the plurality of socket members is configured to detachably couple to one of the plurality of plug members disposed on the first torso panel. The quick release mechanism is disposed on the first torso panel. The quick release mechanism includes a pull cord and a plurality of connecting tapes. The pull cord includes a proximal end portion and a distal end portion. Each of the plurality of connecting tapes includes a first end portion and a second end portion. The first end portion of the each of the plurality of connecting tapes is coupled to the proximal end portion of the pull cord and the second end portion of the each of the plurality of connecting tapes is coupled to the one of the plurality of plug members. The quick release mechanism is configured to separate the first torso panel from the second torso panel.

In another aspect of the present invention, the quickly releasable vest includes a first torso panel, a second torso panel, a plurality of plug members, a plurality of socket members and a quick release mechanism. The first torso panel includes a first side portion and a second side portion. The second torso panel includes a first side portion and a second side portion. The first side portion of the second torso panel is releasably coupled to the second side portion of the first torso panel. The plurality of plug members is disposed on the first side portion of the first torso panel. The plurality of socket members is disposed on the second side portion of the second torso panel. Each of the plurality of socket members configured to detachably couple to one of the plurality of plug members disposed on the first side portion of the first torso panel. The quick release mechanism is disposed on the first torso panel. The quick release mechanism includes a pull cord and a plurality of connecting tapes. The pull cord includes a proximal end portion and a distal end portion. Each of the plurality of connecting tapes includes a first end portion and a second end portion. The first end portion of the each of the plurality of connecting tapes is coupled to the proximal end portion of the pull cord and the second end portion of the each of the plurality of connecting tapes is coupled to the one of the plurality of plug members. The quick release mechanism is configured to separate the first side portion of the first torso panel from the second side portion of the second torso panel.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

The exemplary embodiments described herein detail for illustrative purposes are subject to many variations in structure and design. It should be emphasized, however, that the present invention is not limited to a particular quickly releasable vest, as shown and described. It is understood that various omissions and substitutions of equivalents are contemplated as circumstances may suggest or render expedient, but these are intended to cover the application or implementation without departing from the spirit or scope of the claims of the present invention.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present invention provides a quickly releasable vest capable of protecting a torso portion of a user. The quickly releasable vest includes a first torso panel, a second torso panel, a plurality of plug members, a plurality of socket members and a quick release mechanism. The plurality of plug members is disposed on the first torso panel. The plurality of socket members is disposed on the second torso panel. Each of the plurality of socket members is configured to detachably couple to one of the plurality of plug members disposed on the first torso panel. The quick release mechanism is disposed on the first torso panel. The quick release mechanism includes a pull cord and a plurality of connecting tapes. The pull cord includes a proximal end portion and a distal end portion. Each of the plurality of connecting tapes includes a first end portion and a second end portion. The first end portion of the each of the plurality of connecting tapes is coupled to the proximal end portion of the pull cord and the second end portion of the each of the plurality of connecting tapes is coupled to the one of the plurality of plug members. The quick release mechanism is configured to separate the first torso panel from the second torso panel.

Figure 1:
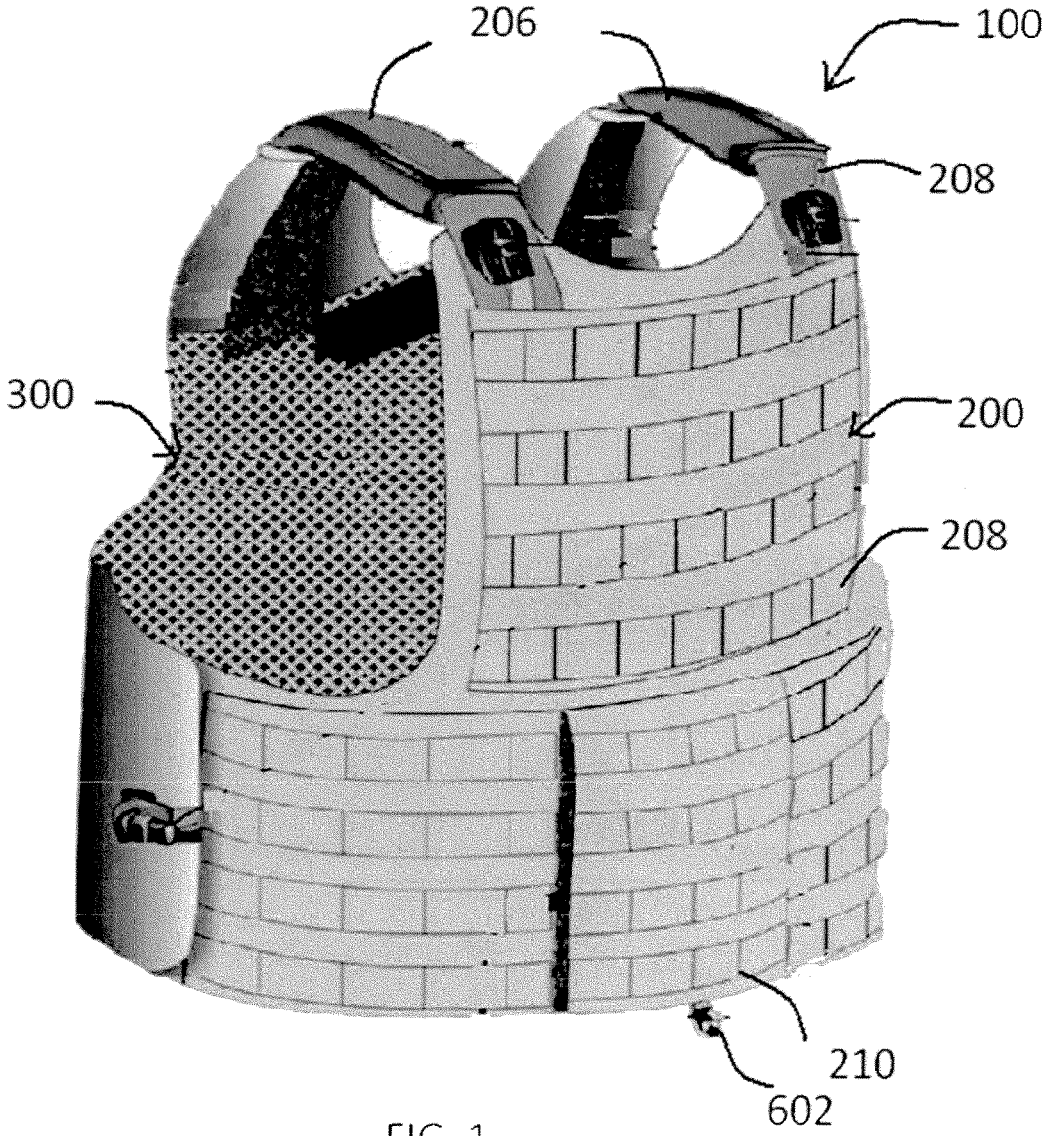
FIG. 1 illustrates a perspective view of a quickly releasable vest including a first torso panel and a second torso panels held together by means of a plurality of plug members and a plurality of socket members, according to an embodiment of the present invention.
Figure 2:
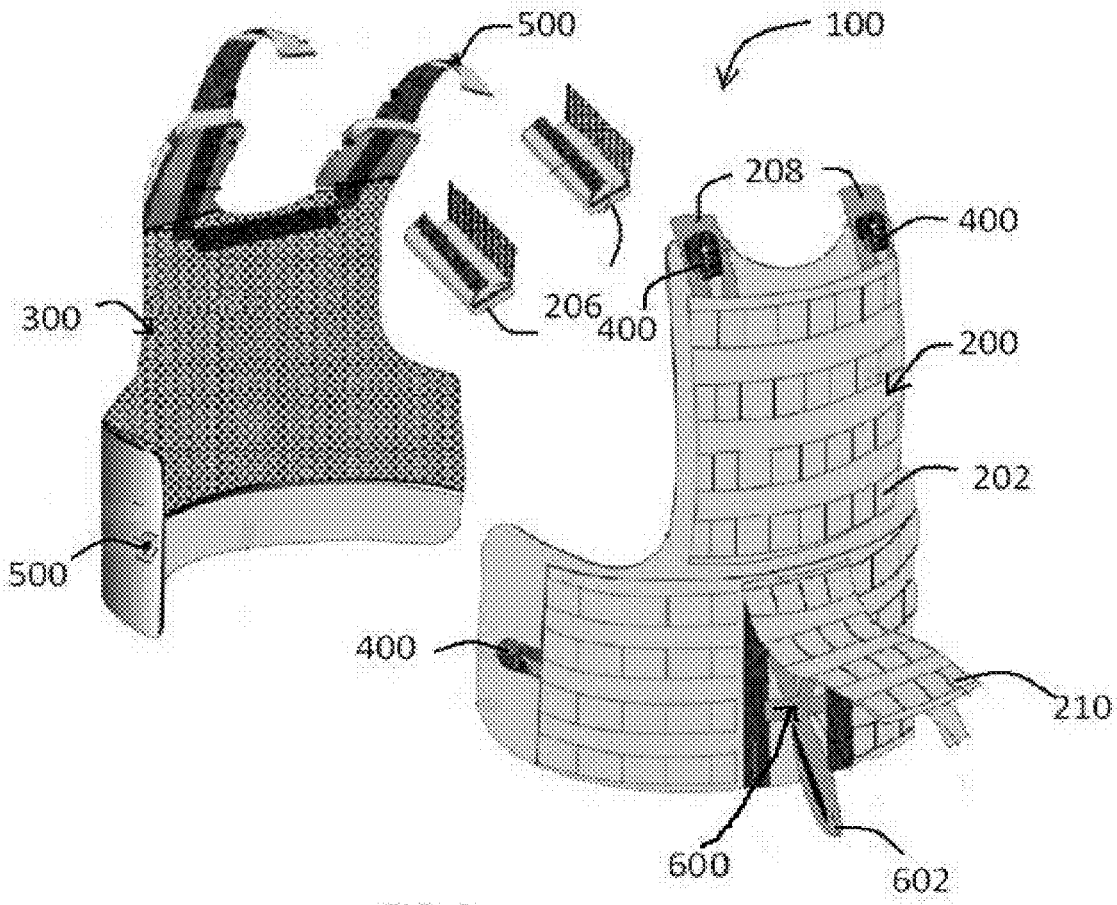
FIG. 2 illustrates a perspective view of a quickly releasable vest including a first torso panel and a second torso panels separated from each away, according to an embodiment of the present invention.
Figure 3:
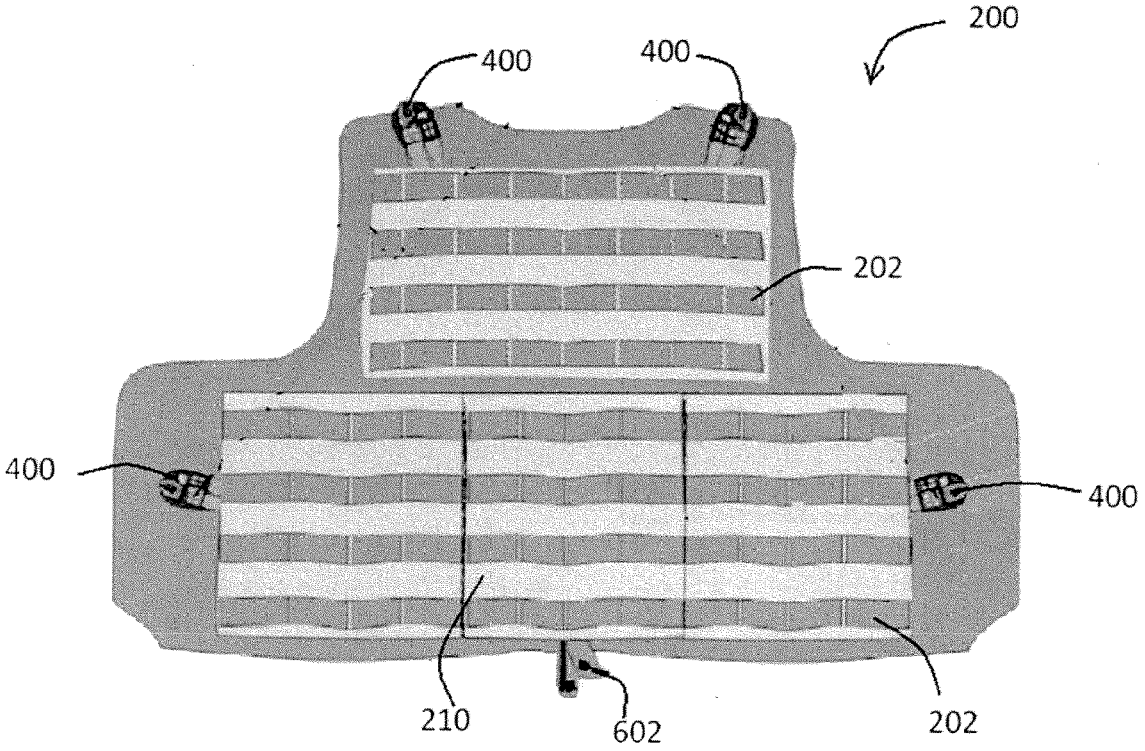
FIG. 3 illustrates a perspective view of an outer surface of the first torso panel of FIG. 1, according to an embodiment of the present invention.

Referring to FIG. 1 and FIG. 2, a quickly releasable vest 100 configured to cover a torso portion of a user in an embodiment of the present invention, is shown. The quickly releasable vest 100 includes a first torso panel 200, a second torso panel 300, a plurality of plug members 400, a plurality of socket members 500 and a quick release mechanism 600 (depicted in FIG. 2).

Further referring to FIG. 1 to FIG. 5B, the first torso panel 200 configured to cover either a front side or a rear side of a torso portion of a user, is shown. In one embodiment of the present invention the first torso panel 200 may cover the front side of the torso portion of the user. In another embodiment of the present invention the first torso panel 200 may cover the rear side of the torso portion of the user. The first torso panel 200 may be made by over lined layers of sewn fabric. In one embodiment of the present invention the first torso panel 200 may accompany a plurality of strips 202, a pair of shoulder pads 206, a pair of shoulder straps 208, a flap 210 and a bullet resistance armor 212.

Figure 4:
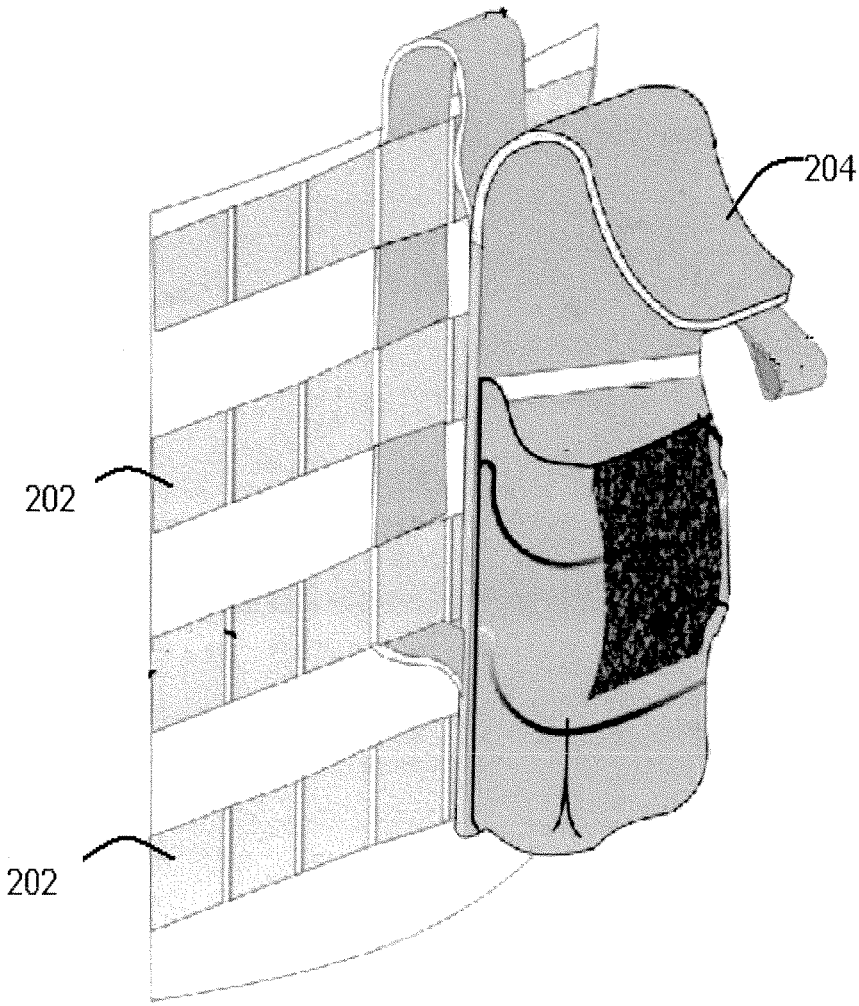
FIG. 4 illustrates a perspective view of a pocket disposed on strips of the first torso panel and the second torso panel for mounting various accessories, according to an embodiment of the present invention.
Figure 5A:
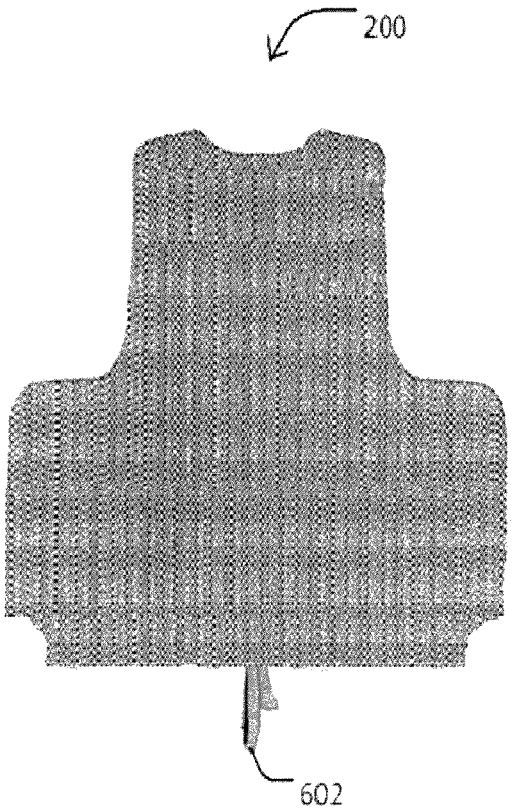
FIG. 5A illustrates a perspective view of an inner surface of a first torso panel, according to an embodiment of the present invention.
Figure 5B:
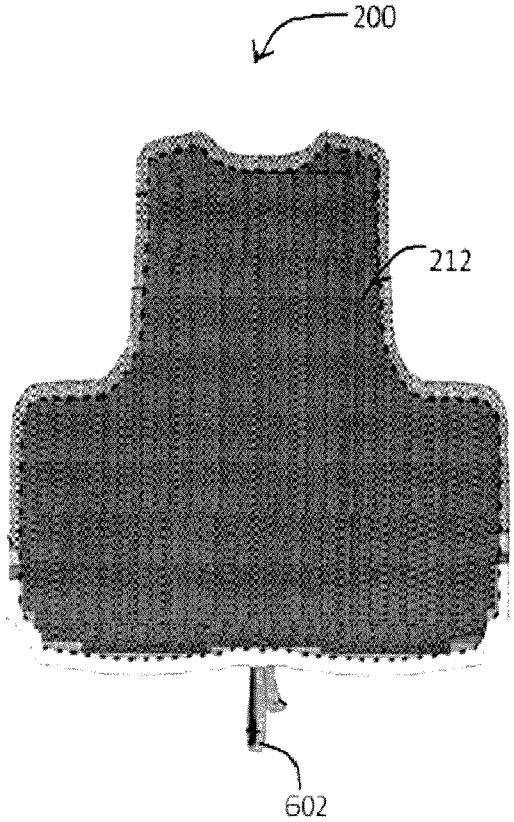
FIG. 5B illustrates a perspective view of an inner surface of a first torso panel with a bullet resistant armor, according to an embodiment of the present invention.

The plurality of strips 202 may be disposed both vertically and horizontally on the first torso panel to accommodate various accessories such as pouches, magazines, water carrier, medical kit, small portable walkie-talkie sets and other similar equipments which can be positioned or fixed as per the convenience of the user. The construction of the plurality of strips 202 permits positioning of accessory pouch etc. at different locations on the first torso panel 200. More specifically, FIG. 4 illustrates a pocket 204 disposed on the plurality of strips 202 of the first torso panel 200 for mounting various accessories. The pair of shoulder straps 208 is disposed on shoulder portions of the first torso panel 200. The shoulder pad 206 is configured to cover a substantial portion of the shoulder strap 208. The shoulder pad 206 is configured to provide cushioning to shoulder portions of the user. As depicted in FIG. 2, the flap 210 is configured to cover a portion of the quick release mechanism 600. The flap 210 may also include the plurality of strips 202. The bullet resistance armor 212 may be disposed on the first torso panel 200. In one embodiment of the present invention, as shown in FIG. 5B the bullet resistant armor 212 may be disposed, on an inner surface of the first torso panel 200. In another embodiment of the present invention the bullet resistant armor 212 may be disposed on an outer surface of the first torso panel 200. The first torso panel 200 and the second torso panel 300 are configured to cover the torso portion of the user.

Figure 6:
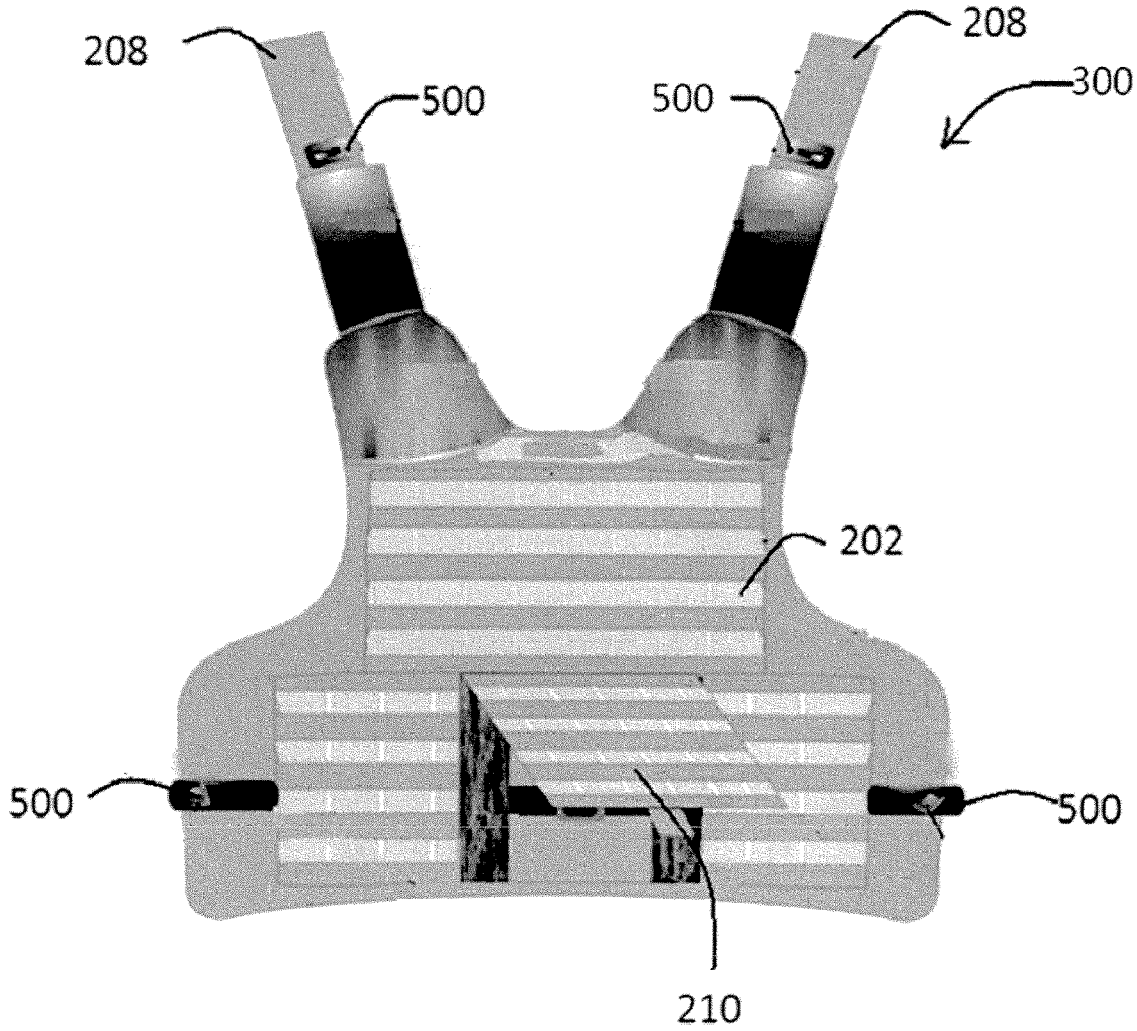
FIG. 6 illustrates a perspective view of an outer surface of the second torso panel of FIG. 1, according to an embodiment of the present invention.
Figure 7A:
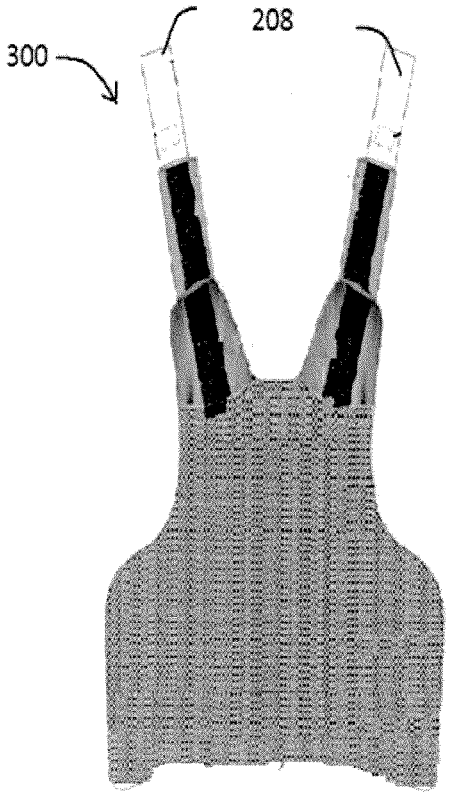
FIG. 7A illustrates a perspective view of an inner surface of a second torso panel, according to an embodiment of the present invention.
Figure 7B:
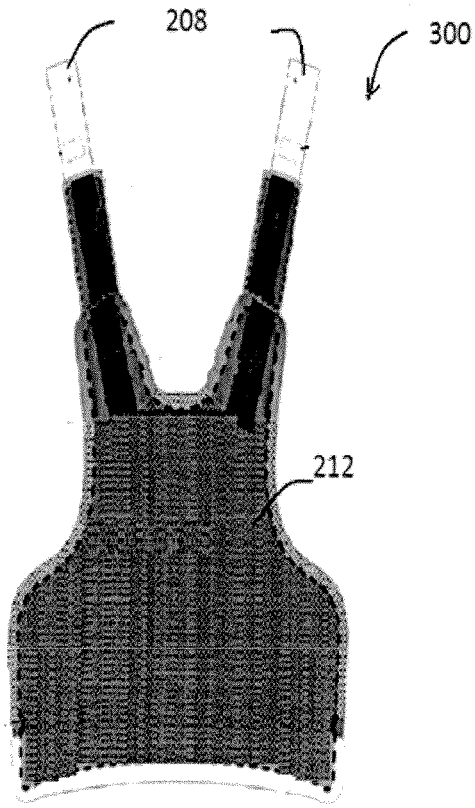
FIG. 7B illustrates a perspective view of an inner surface of a second torso panel with a bullet resistant armor, according to an embodiment of the present invention.

With reference to FIG. 6, FIG. 7*a* and FIG. 7*b*, the second torso panel 300 configured to cover either a rear side or a front side of a torso portion of a user, is shown. In one embodiment of the present invention the second torso panel 300 may cover the rear side of the torso portion of the user. In another embodiment of the present invention the second torso panel 300 may cover the front side of the torso portion of the user. In one embodiment of the present invention the second torso panel 300 may accompany a plurality of strips 202, a pair of shoulder straps 208, a flap 210 and a bullet resistance armor 212.

The plurality of strips 202 may be disposed both vertically and horizontally on the second torso panel 300 to accommodate various accessories such as pouches, magazines, water carrier, medical kit, small portable walkie-talkie sets and other similar equipments which can be positioned or fixed as per the convenience of a wearer. The construction of the plurality of strips 202 permits positioning of accessory pouch etc. at different locations on the second torso panel 300. More specifically, FIG. 4 illustrates the pocket 204 disposed on the plurality of strips 202 of the second torso panel 300 for mounting various accessories. The pair of shoulder straps 208 may be disposed on shoulder portions of the second torso panel 300. The flap 210 is configured to pivotally cover a lower portion of the second torso panel 300. The flap 210 may also include the plurality of strips 202. The bullet resistance armor 212 may be disposed on the second torso panel 200. In one embodiment of the present invention, as shown in FIG. 7B the bullet resistant armor 212 may be disposed on an inner surface of the second torso panel 300 of the quickly releasable vest 100. In another embodiment of the present invention the bullet resistant armor 212 may be disposed on an outer surface of the second torso panel 300 of the quickly releasable vest 100.

Figure 8:
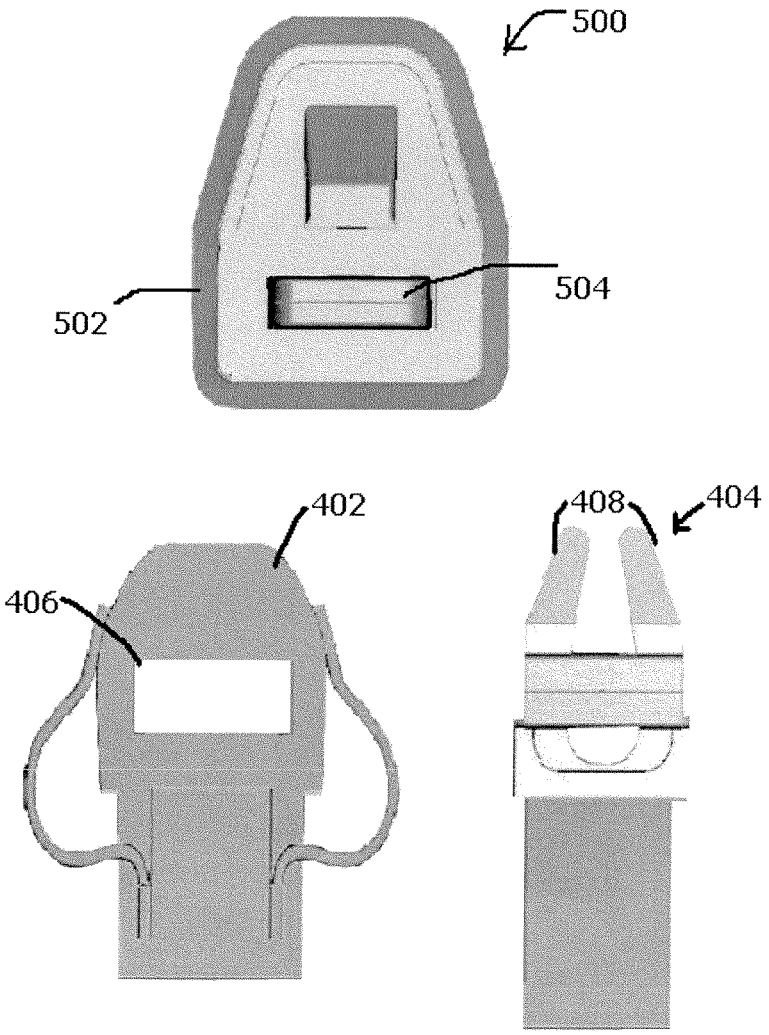
FIG. 8 illustrates a perspective view of a plug member and a socket member separately, according to an embodiment of the present invention.
Figure 9:
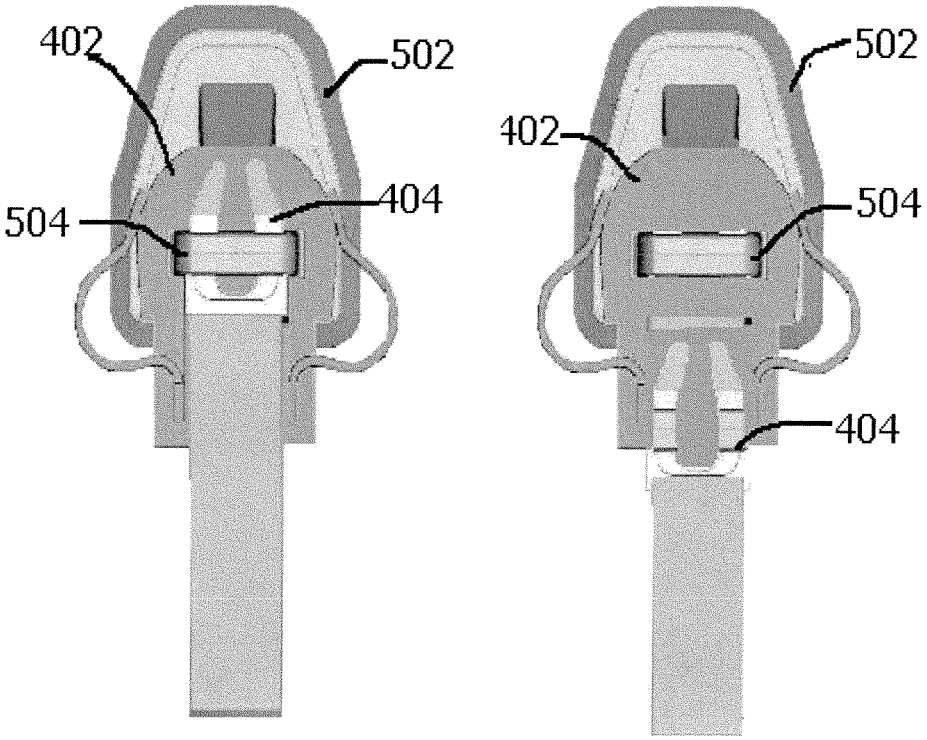
FIG. 9 illustrates a perspective view of a plug member and a socket member in fastened position and in released position, according to an embodiment of the present invention.
Figure 10:
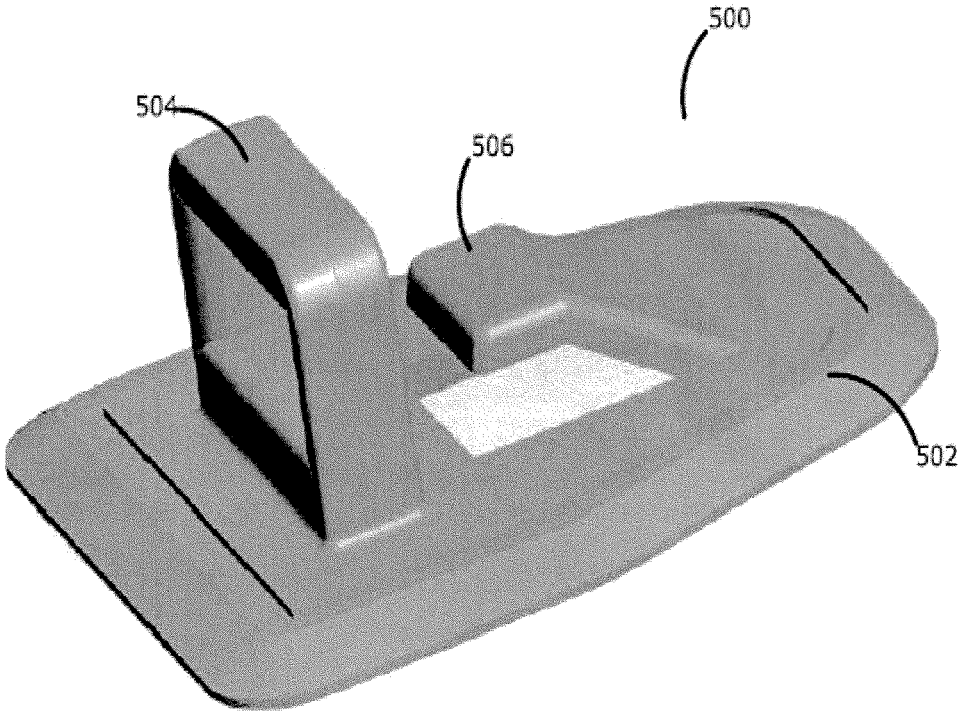
FIG. 10 illustrates a perspective view of a socket member comprising a spring member, according to an embodiment of the present invention.
Figure 11:
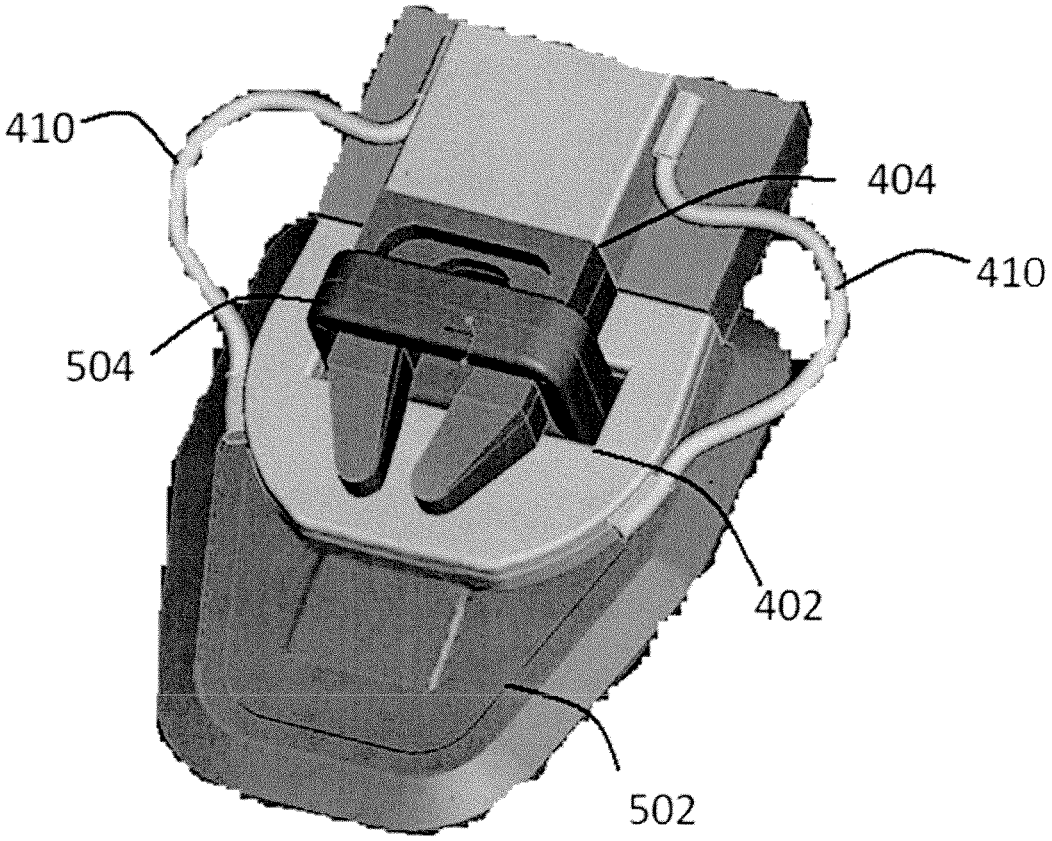
FIG. 11 illustrates a perspective view of a plug member and a socket member in fastened position, wherein the plug member includes a pair of connecting wires, according to an embodiment of the present invention.

As shown in FIG. 8, FIG. 9 and FIG. 11 the quickly releasable vest 100 further includes the plurality of plug members 400. The plurality of plug members 400 is disposed on the first torso panel 200. In one embodiment of the present invention, the plurality of plug members 400 is disposed on the shoulder strap 208 of the first torso panel 200. In one embodiment of the present invention each of the plurality of plug members 400 includes an eye hook 402 and a tongue 404. The eye hook 402 includes an eye opening 406. In one embodiment of the present invention the eye opening 406 is rectangular in configuration. The tongue 404 includes a pair of engaging legs 408. The engaging legs 408 are curved inwardly towards each other. In another embodiment of the present invention each of the plurality of plug members 400 further includes a pair of connecting wires 410 (shown in FIG. 11)). Each of the pair of connecting wires 410 is configured to connect a side portion of the eye hook 402 to a side portion of the tongue 404. The tongue 404 is configured to be received in one of the plurality of socket members 500 disposed on the second torso panel 300. Although in the present invention each of the plurality of plug members 400 have been described with respect to particular embodiments but they are not intended to be exhaustive or to limit the present invention to the precise forms disclosed. Each of the plurality of plug members 400 is configured to detachably couple to one of the plurality of socket members 500 disposed on the second torso panel 300.

Referring to FIG. 8, FIG. 9 FIG. 10 and FIG. 11 the plurality of socket members 500 configured to be detachably couple to the plurality of plug members 400, is shown. The plurality of socket members 500 is disposed on the second torso panel 300. In one embodiment of the present invention, the plurality of socket members 500 is disposed on the shoulder strap 208 of the second torso panel 300. In one embodiment of the present invention the each of the plurality of socket members 500 includes a base plate 502 and a rigid head 504. The rigid head 504 is disposed perpendicularly to the base plate 502. The rigid head 504 is configured to hook the eye hook 402. Further, the rigid head 504 is also configured to receive the tongue 404. In another embodiment of the present invention the each of the plurality of socket members 500 further includes a spring member 506. The spring member 506 is disposed on the base plate 502 of the each of the plurality of socket members 500. In one embodiment of the present invention the spring member 506 is hingedly connected to the base plate 502 of the socket members 500. The spring member 506 is configured to force out the eye hook 402 from the rigid head 504 when the tongue 404 is pulled out of the rigid head 504. The tongue 404 may be pulled out of the rigid head 504 by means of the quick release mechanism 600.

Figure 12:
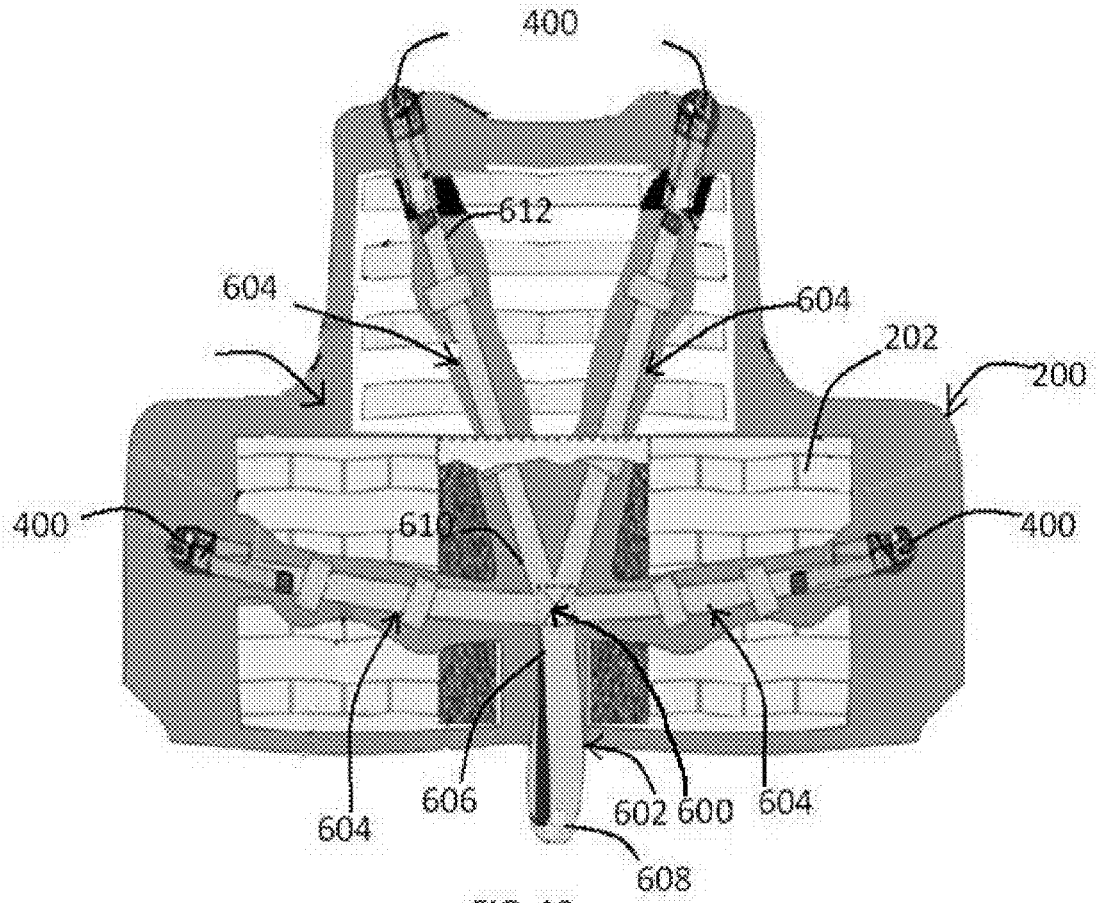
FIG. 12 illustrates a perspective view of a quick release mechanism disposed on the first torso panel, according to an embodiment of the present invention.
Figure 13:
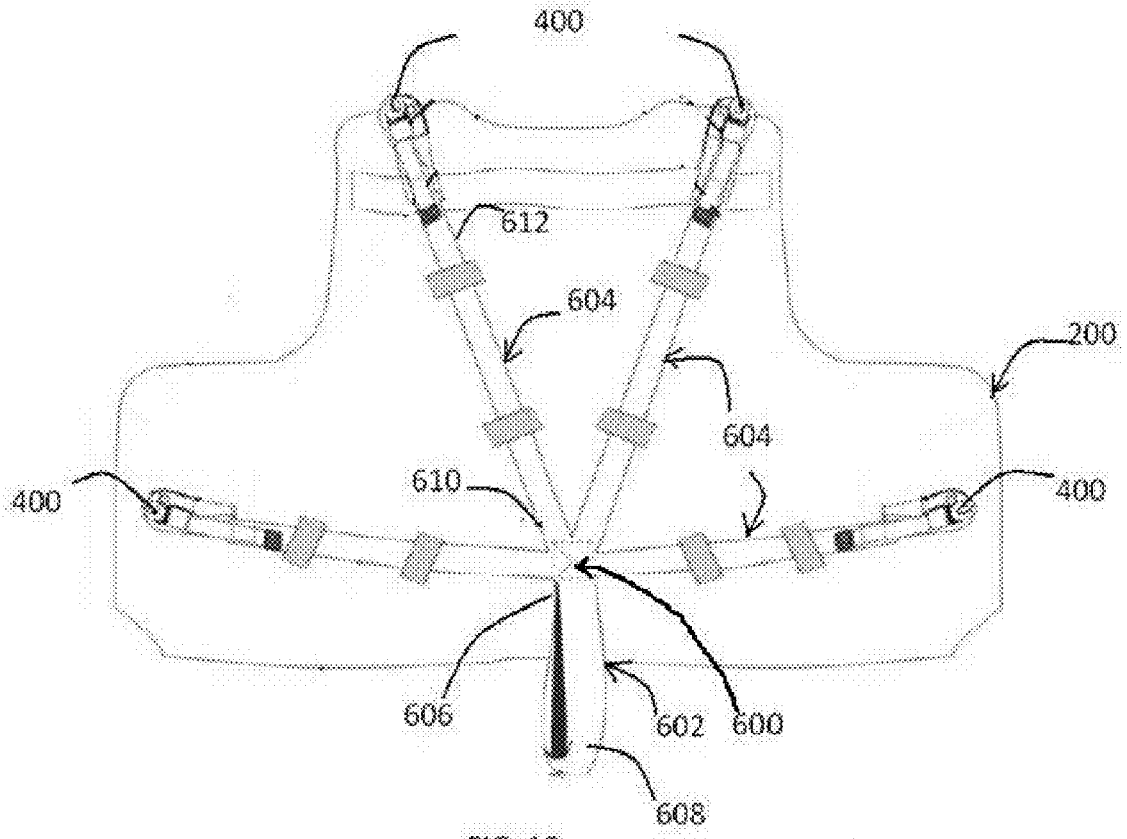
FIG. 13 illustrates a perspective view of a quick release mechanism disposed on the first torso panel, according to an embodiment of the present invention.

Now referring to FIG. 12 and FIG. 13, the quick release mechanism 600 disposed on the first torso panel 200, is shown. The quick release mechanism 600 includes a pull cord 602 and a plurality of connecting tapes 604. The pull cord 602 has a proximal end portion 606 and a distal end portion 608. Each of the plurality of connecting tapes 604 includes a first end portion 610 and a second end portion 612. The first end portion 610 of the each of the plurality of connecting tapes 604 is coupled to the proximal end portion 606 of the pull cord 602 and the second end portion 612 of the each of the plurality of connecting tapes 604 is coupled to the one of the plurality of plug members 400. More specifically, the each of the plurality of connecting tapes 604 is coupled to one of the tongue 404 of the plurality of plug members 400. Further, the distal end portion 608 of the pull cord 602 may be coupled to a grip (not shown). In one embodiment of the present invention, the pull cord 602 of the quick release mechanism 600 is positioned at the lower portion of the first torso panel 200 for easy and quick access by the user for the purpose of quick release of the first torso panel 200 from the second torso panel 300. In one embodiment of the present invention, the pull cord 602 of the quick release mechanism 600 may be covered by the flap 210 of the first torso panel 200. The pull cord 602 is configured to separate the first torso panel 200 and the second torso panel 300 from each other, when the pull cord 602 is pulled downwards.

In use, while dressing in the quickly releasable vest 100, the wearer has to place the first torso panel 200 over the second torso panel 300 so that the inner faces of both the first torso panel 200 and the second torso panel 300 are placed one over the other and fully aligned with each other. Thereafter the eye hook 402 of the plurality of plug members is hooked to the rigid head 504 of the plurality of socket members 500, and then the tongue 404 of the plurality of plug members is inserted into the rigid head 504 of the plurality of socket members 500 over the eye hook 402. In one embodiment of the present invention the shoulder straps 208 of the second torso panel 300 are inserted partially in a slot (not shown) disposed on the first torso panel 200 so that the shoulder strap 208 of the first torso panel 200 may be placed over the shoulder strap 208 of the second torso panel 300. Thereafter the eye hook 402 of the plurality of plug members is hooked to the rigid head 504 of the plurality of socket members 500, and then the tongue 404 of the plurality of plug members 400 is inserted into the rigid head 504 of the plurality of socket members 500 over the eye hook 402. This process is to be repeated mutatis mutandis at all the points where the first torso panel 200 is releasably attached with the second torso panel 300.

Similarly, while separating the quickly releasable vest 100 from the torso portion of the user, the user has to drag the pull cord 602 downwards by applying downward pressure on the connecting tapes 604. Accordingly, in one embodiment of the present invention, the connecting tapes 604 pulls the tongue 404 of the plurality of plug members 400 out of the rigid head 504 and while being pulled out, the tongue 404 also pulls out the eye hook 402 by means of the pair of connecting wires 410. In another embodiment of the present invention, the connecting tapes 604 pull the tongue 404 of the plurality of plug members 400 out of the rigid head 504. As, the tongue 404 is pulled out of the rigid head 504, the spring member 506 forces the eye hook 402 to be unhooked from the rigid head 504.

Figure 14:
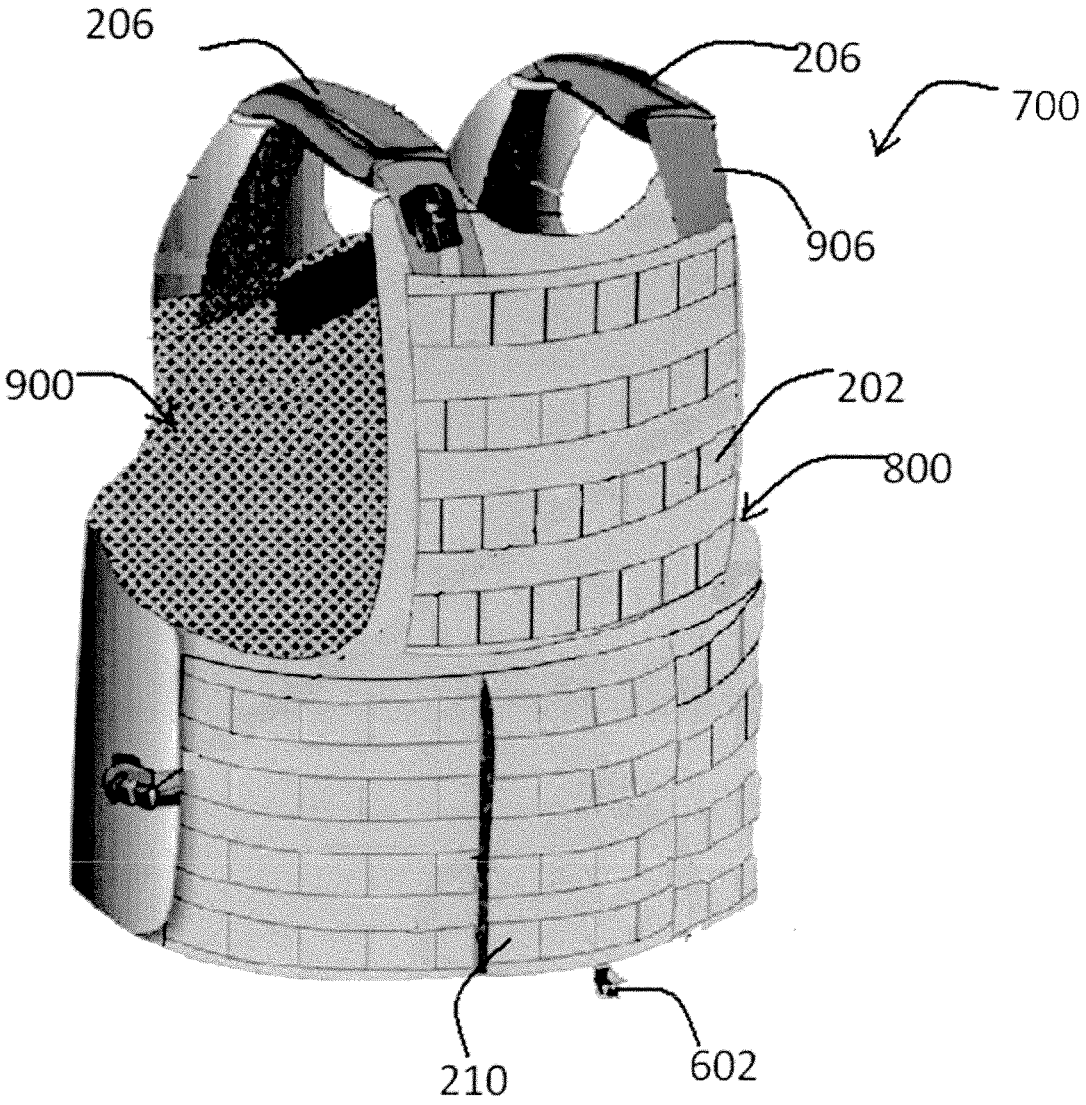
FIG. 14 illustrates a perspective view of a quickly releasable vest including a first torso panel and a second torso panels held together by means of a plurality of plug members and a plurality of socket members, according to an another embodiment of the present invention.

FIG. 14 to FIG. 17 illustrates another embodiment of a quickly releasable vest in accordance with the present invention. More specifically, FIG. 14 illustrates the quickly releasable vest 700 configured to cover a torso portion of a user. The quickly releasable vest 700 includes a first torso panel 800, a second torso panel 900, a plurality of plug members 1000, a plurality of socket members 1100 and a quick release mechanism 1200.

Figure 15:
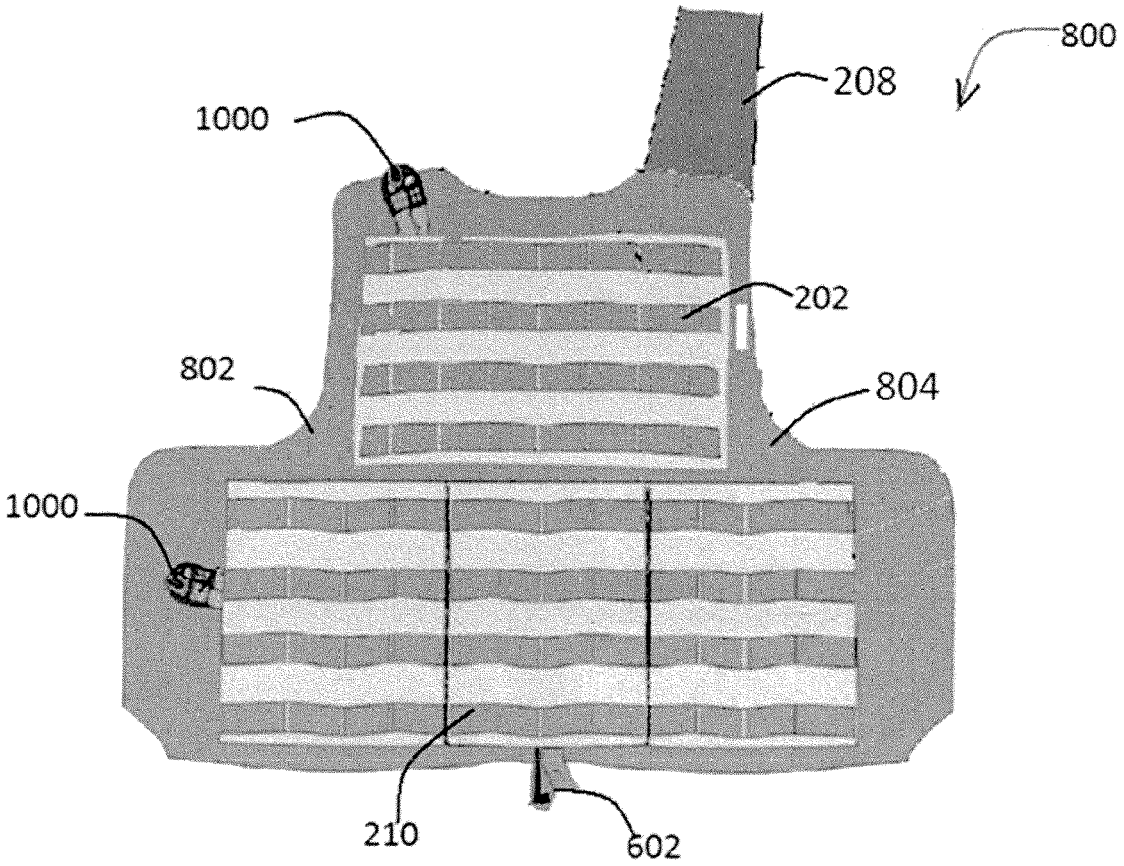
FIG. 15 illustrates a perspective view of an outer surface of the first torso panel of FIG. 14, according to an another embodiment of the present invention.

Now referring to FIG. 15, the first torso panel 800 configured to cover either a front side or a rear side of a torso portion of a user, is shown. In one embodiment of the present invention the first torso panel 800 may cover the front side of the torso portion of the user. In another embodiment of the present invention the first torso panel 800 may cover the rear side of the torso portion of the user. The first torso panel 800 includes a first side portion 802 and a second side portion 804. The first torso panel 800 may be made by over lined layers of sewn fabric. In one embodiment of the present invention the first torso panel 800 may accompany the plurality of strips 202, the pair of shoulder pads 206, the pair of shoulder straps 208, the flap 210 and the bullet resistance armor 212. The plurality of strips 202, the pair of shoulder pads 206, the pair of shoulder straps 208, the flap 210 and the bullet resistance armor 212 are configured and disposed on the first torso panel 800 similarly as they are configured and disposed on the first torso panel 200. The first torso panel 800 and the second torso panel 900 are configured to cover the torso portion of the user.

Figure 16:
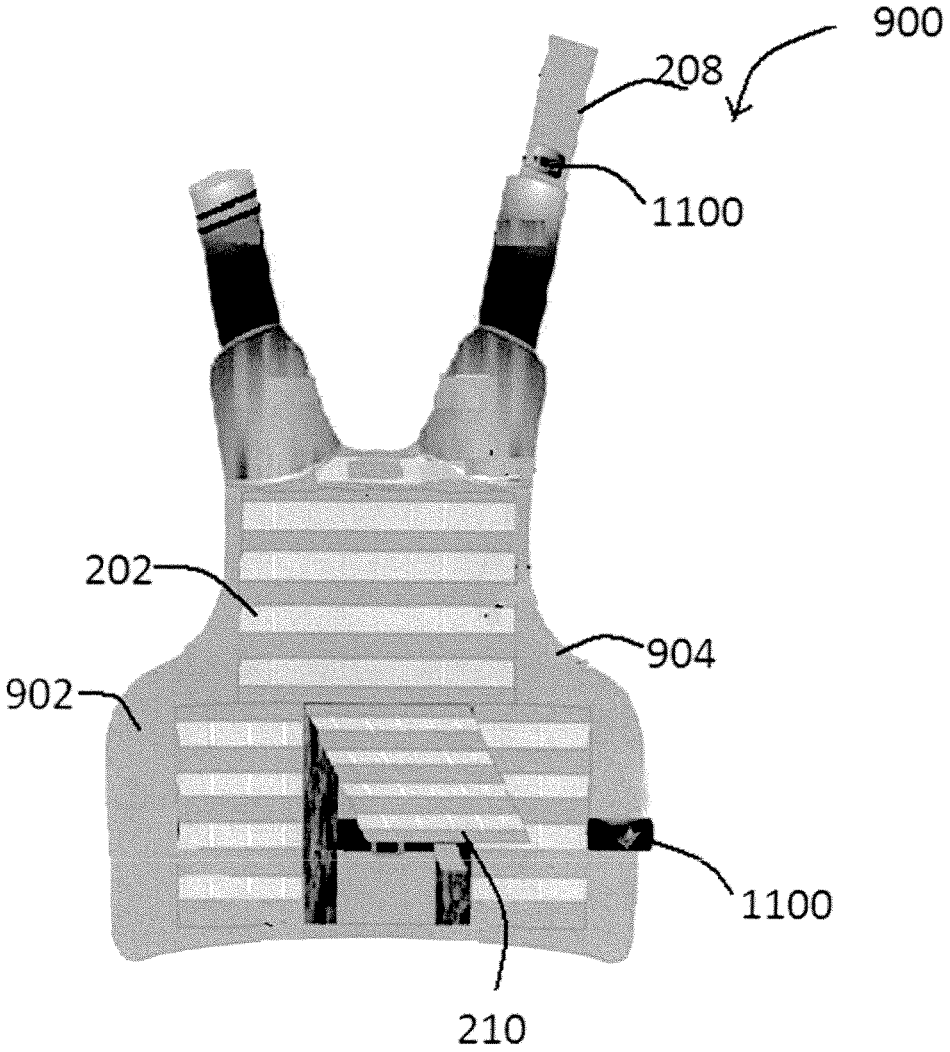
FIG. 16 illustrates a perspective view of an outer surface of the second torso panel of FIG. 14, according to another embodiment of the present invention.
Figure 17:
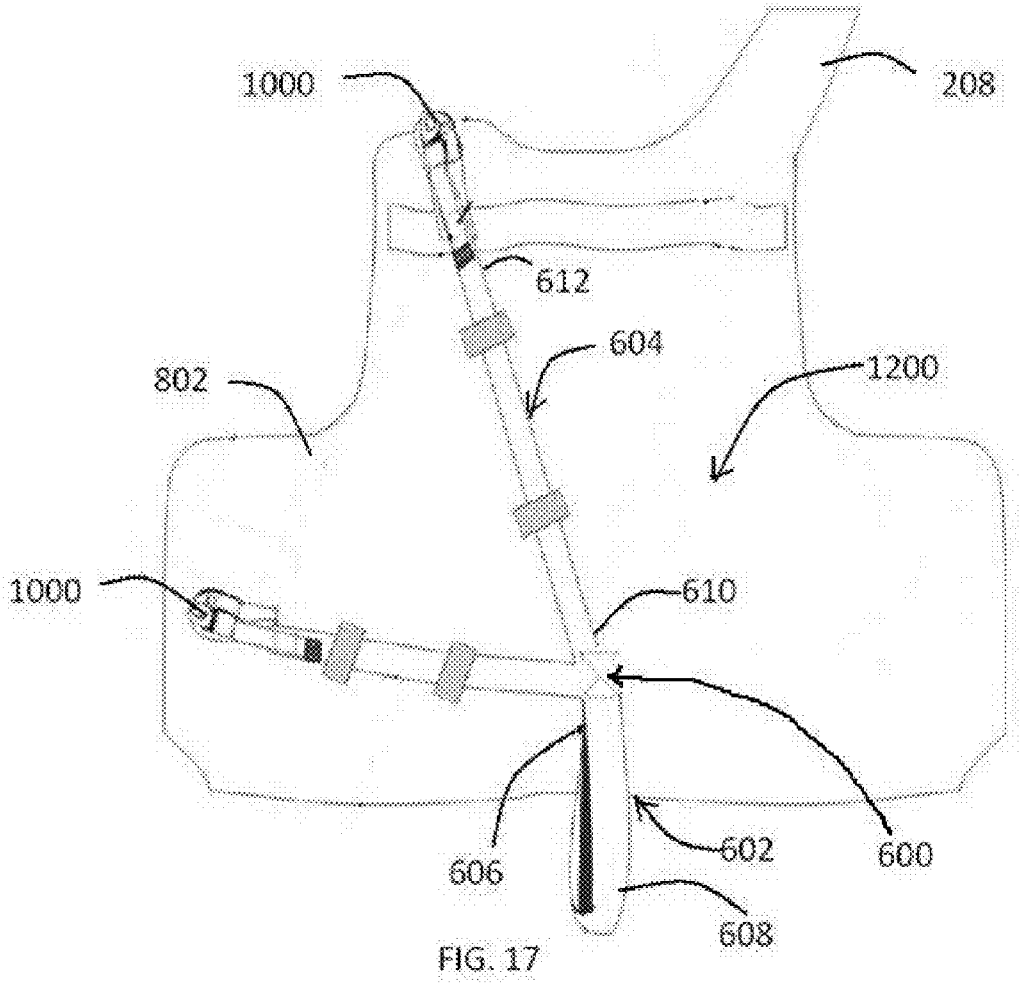
FIG. 17 illustrates a perspective view of a quick release mechanism disposed on the first torso panel of FIG. 15, according to an another embodiment of the present invention.

As shown in FIG. 16, the second torso panel 900 is configured to cover either a rear side or a front side of a torso portion of a user. In one embodiment of the present invention the second torso panel 900 may cover the rear side of the torso portion of the user. In another embodiment of the present invention the second torso panel 900 may cover the front side of the torso portion of the user. The second torso panel 900 includes a first side portion 902 and a second side portion 904. The first side portion 902 of the second torso panel 900 is releasably coupled to the second side portion 804 of the first torso panel 800. In one embodiment of the present invention the first side portion 902 of the second torso panel 900 is releasably coupled to the second side portion 804 of the first torso panel 800 by means of an adhesive tape 906. In another embodiment of the present invention, the first side portion 902 of the second torso panel 900 is permanently coupled to the second side portion 804 of the first torso panel 800. The first side portion 902 of the second torso panel 900 may be permanently coupled to the second side portion 804 of the first torso panel 800 by means of stitching or any other means known in the art. In one embodiment of the present invention the second torso panel 900 may accompany the plurality of strips 202, the pair of shoulder straps 208, the flap 210 and the bullet resistance armor 212. The plurality of strips 202, the pair of shoulder straps 208, the flap 210 and the bullet resistance armor 212 are configured and disposed on the second torso panel 900 similarly as they are configured and disposed on the second torso panel 300 of the quickly releasable vest 100.

The quickly releasable vest 700 further includes the plurality of plug members 1000. The plurality of plug members 1000 is similar to the plurality of plug members 400 explained above in the first embodiment of the present embodiment. The plurality of plug members 1000 is disposed on the first side portion 802 of the first torso panel 800. In one embodiment of the present invention, the first side portion 802 of the first torso panel 800 is on the left hand side of a right handed user. In another embodiment of the present invention, the first side portion 802 of the first torso panel 800 is on the right hand side of a left handed user. Each of the plurality of plug members 1000 is configured to be detachably couple to one of the plurality of socket members 1100. The plurality of socket members 1100 are similar to the plurality of socket members 500 explained above in the first embodiment of the present invention. The plurality of socket members 1100 is disposed on the second side portion 904 of the second torso panel 900. The first side portion 802 of the first torso panel 800 may be separated from the second side portion 904 of the second torso panel 900 by means of the quick release mechanism 1200 (shown in FIG. 17). The quick release mechanism 1200 is also similar to the quick release mechanism 600 explained in the first embodiment of the present invention. The quick release mechanism 1200 is disposed on the first torso panel 800.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilize the present invention and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the claims of the present invention.

What is claimed is:

1. A quickly releasable vest for protecting a torso portion of a user, the quickly releasable vest comprising:

a first torso panel comprising two side portions and two shoulder portions;

a second torso panel comprising two side portions and two shoulder portions;

a plurality of plug members disposed on the first torso panel, at least one of the plurality of socket members comprising a head;

a plurality of socket members disposed on the second torso panel, wherein at least two socket member of the plurality of socket members is located at the two shoulder portions of the second torso panel, respectively, and at least two socket member of the plurality of socket members is located at the two side portions of the second torso panel, respectively, each of the plurality of socket members configured to detachably couple to one of the plurality of plug members disposed on the first torso panel, wherein at least two plug member of the plurality of plug members is located at the two shoulder portions of the first torso panel, respectively, and at least two plug member of the plurality of plug members is located at the two side portions of the first torso panel, respectively, at least one plug member of the plurality of plug members comprising an eye hook, tongue, and release member, the eye hook configured to receive the head of the at least one socket member and the head of the at least one socket member configured to receive the tongue to secure the at least one plug member to the at least one socket member, the release member configured to separate the eye hook from the head after the tongue is removed from the head of the at least one socket member; and a quick release mechanism disposed on the first torso panel, the quick release mechanism comprising a pull cord and a plurality of connecting tapes, the pull cord comprising a proximal end portion and a distal end portion, each of the plurality of connecting tapes comprising a first end portion and a second end portion, the first end portion of the each of the plurality of connecting tapes coupled to the proximal end portion of the pull cord and the second end portion of the each of the plurality of connecting tapes coupled to each of the plurality of plug members, respectively, wherein at least one of the second end portions is coupled to the tongue of the at least one plug member, wherein the quick release mechanism is configured to at least assist in removing the tongue from the head of the at least one socket member and the release member is configured to at least assist in separating the eye hook from the head after the tongue is removed, wherein the quick release mechanism is configured to completely separate the first torso panel from the second torso panel.

2. The quickly releasable vest of claim 1, wherein the release member comprises connecting wire with a proximal end portion and a distal end portion, the proximal end portion coupled to the tongue and the distal end portion coupled to the eye hook, wherein the connection wire is configured to assist in pulling the eye hook from the head after the tongue is removed from the head.

3. The quickly releasable vest of claim 1, wherein the head is rigid.

4. The quickly releasable vest of claim 1, wherein the release member comprises a spring member, the spring member configured to push the plug member away from the head of the socket member after the tongue is removed from the head.

5. The quickly releasable vest of claim 1, wherein the distal end portion of the pull cord is coupled to a grip.

6. The quickly releasable vest of claim 1, further comprising a plurality of strips disposed horizontally and vertically on the first torso panel and the second torso panel for mounting various accessories.

7. The quickly releasable vest of claim 1, further comprising a bullet resistance armor disposed on at least one of the first torso panel and the second torso panel.

8. A quickly releasable vest for protecting a torso portion of a user, the quickly releasable vest comprising:

a first torso panel, the first torso panel comprising a first side portion and a second side portion;

a second torso panel, the second torso panel comprising a first side portion and a second side portion, the first side portion of the second torso panel is releasably coupled to the second side portion of the first torso panel and the second side portion of the second torso panel is releasably coupled to the first side portion of the first torso;

a plurality of plug members disposed on the first side portion of the first torso panel and a second side portion of the first torso panel, at least one plug member of the plurality of plug members comprising an eye hook, tongue, and release member;

a plurality of socket members disposed on the first side portion of the second torso panel and the second side portion of the second torso panel, each of the plurality of socket members configured to detachably couple to one of the plurality of plug members disposed on the first side portion of the first torso panel and the second side portion of the second torso panel, respectively, at least one of the plurality of socket members comprising a head, the eye hook of the at least one plug member configured to receive the head of the at least one socket member and the head of the at least one socket member configured to receive the tongue to secure the at least one plug member to the at least one socket member, the release member configured to separate the eye hook from the head after the tongue is removed from the head of the at least one socket member; and a quick release mechanism disposed on the first torso panel, the quick release mechanism comprising a pull cord and a plurality of connecting tapes, the pull cord comprising a proximal end portion and a distal end portion, each of the plurality of connecting tapes comprising a first end portion and a second end portion, the first end portion of the each of the plurality of connecting tapes coupled to the proximal end portion of the pull cord and the second end portion of the each of the plurality of connecting tapes coupled to each of the plurality of plug members, respectively, wherein at least one of the second end portions is coupled to the tongue of the at least one plug member, wherein the quick release mechanism is configured to at least assist in removing the tongue from the head of the at least one socket member and the release member is configured to at least assist in separating the eye hook from the head after the tongue is removed, wherein the quick release mechanism is configured to completely separate the first side portion of the first torso panel from the second side portion of the second torso panel and to completely separate the second side portion of the first torso panel from the first side portion of the second torso panel.

9. The quickly releasable vest of claim 8, wherein the release member comprises a connecting wire with a proximal end portion and a distal end portion, the proximal end portion coupled to the tongue and the distal end portion coupled to the eye hook, wherein the connection wire is configured to assist in pulling the eye hook from the head after the tongue is removed from the head.

10. The quickly releasable vest of claim 8, wherein the head is rigid.

11. The quickly releasable vest of claim 8, wherein the release member comprises a spring member, the spring member configured to push the plug member away from the head of the socket member after the tongue is removed from the head.

12. The quickly releasable vest of claim 8, wherein the distal end portion of the pull cord is coupled to a grip.

13. The quickly releasable vest of claim 8, wherein the first side portion of the second torso panel is releasably coupled to the second side portion of the first torso panel by means of an adhesive tape.

14. The quickly releasable vest of claim 8, further comprising a plurality of strips disposed horizontally and vertically on the first torso panel and the second torso panel for mounting various accessories.

15. The quickly releasable vest of claim 8, further comprising a bullet resistance armor disposed on at least one of the first torso panel and the second torso panel.

16. A quickly releasable vest comprising:

a first torso panel;

a second torso panel;

a plurality of plug members disposed on the first torso panel, at least one of the plurality of plug members comprising an eye hook, a tongue, and a release member;

a plurality of socket members disposed on the second torso panel, at least one of the plurality of socket members comprising a head configured to be received by the eye hook, the head further configured to receive the tongue after the head is received by the eye hook to secure the at least one socket member to the at least one plug member;

a quick release mechanism comprising a pull cord and a plurality of connecting tapes, the pull cord comprising a proximal end portion and a distal end portion, each of the plurality of connecting tapes comprising a first end portion and a second end portion, the first end portion of the each of the plurality of connecting tapes coupled to the proximal end portion of the pull cord and the second end portion of the each of the plurality of connecting tapes coupled to each of the plurality of plug members, respectively, wherein at least one of the second end portions of at least one of the plurality of connecting tapes is coupled to the tongue, wherein the quick release mechanism is configured to at least assist in removing the tongue from the head and the release member is configured to at least assist in separating the eye hook from the head after the tongue is removed from the head to separate the first torso panel from the second torso panel.

17. The quickly releasable vest of claim 16, wherein the release member comprises a connecting wire with a proximal end portion and a distal end portion, the proximal end portion coupled to the tongue and the distal end portion coupled to the eye hook, wherein the connection wire is configured to assist in pulling the eye hook from the head after the tongue is removed from the head.

18. The quickly releasable vest of claim 16, wherein the release member comprises a spring member, the spring member configured to push the plug member away from the head of the socket member after the tongue is removed from the head.

* * * * *